United States Patent [19]

Schreiber

[11] Patent Number: 4,961,515

[45] Date of Patent: Oct. 9, 1990

[54] CLOSURE FOR A BOTTLE

[76] Inventor: Alexander R. Schreiber, 159 Windsong St., Thousand Oaks, Calif. 91360

[21] Appl. No.: 413,118

[22] Filed: Sep. 27, 1989

[51] Int. Cl.[5] ..... B65D 47/00

[52] U.S. Cl. ..... 222/48; 222/553

[58] Field of Search ..... 222/23, 41, 48, 153, 222/519, 531–532, 553; 215/316, 321, 330, 343–345

[56] References Cited

U.S. PATENT DOCUMENTS

| | | | |
|---|---|---|---|
| 2,041,351 | 5/1936 | Jones | 222/545 |
| 2,173,030 | 9/1939 | White | 222/512 |
| 2,189,343 | 2/1940 | Fritz | 222/553 |
| 2,272,260 | 2/1942 | Ballentine et al. | 222/482 |
| 2,361,047 | 10/1944 | Morey | 222/553 |
| 2,889,081 | 6/1959 | Spencer | 222/153 |
| 2,966,286 | 12/1960 | Moran | 222/553 |
| 3,261,513 | 7/1966 | Moran | 222/519 |
| 4,583,667 | 4/1986 | Fishman et al. | 222/142.6 |

FOREIGN PATENT DOCUMENTS

| | | | |
|---|---|---|---|
| 357670 | 11/1961 | Switzerland | 222/553 |

*Primary Examiner*—Michael S. Huppert

[57] ABSTRACT

A twist open, twist close bottle closure is provided in a plastic cap with a modified plastic bottle neck. Depending from an interior top surface of the cap is an annular exterior wall and a concentrically positioned annular interior wall forming a chamber between the two walls sized to receive the bottle neck. The interior upper surface of the chamber is affixed with three annular seal rings adapted to mesh with grooves in the top edge of the bottle neck. A larger central annular seal ring extends downward forming a tongue designed to be pressed into the larger central groove of the bottle neck. This tongue and groove connection forms a tight fluid seal while still allowing rotational movement. Dispensing apertures in the cap and a notch in the upper edge of the bottle neck are positioned to be aligned by rotation of the cap to form an open dispensing canal. A stop block is located on the lower bottom exterior of the bottle neck, and a second stop block is located on the lower interior cap rim to limit rotation in order to indicate an opened dispensing canal. To indicate a closed dispensing canal, a domed pin located on an interior surface of the exterior wall of the cap inserts into a dimple on the exterior of the bottle neck during clockwise rotation of the cap.

4 Claims, 7 Drawing Sheets

CLOSURE FOR A BOTTLE

BACKGROUND OF THE INVENTION

1. Field of the Invention

This invention relates to bottle closures in general and more precisely to a twist open, twist close plastic dispensing cap and cooperatively structured bottle neck on a bottle. The bottle closure provides improved fluid seals and a novel dispensing aperture arrangement.

2. Description of the Prior Art

A wide variety of dispensing closures have been introduced over the years for dispensing an almost unlimited assortment of products from containers. A major feature common to many of these closures is that the cap is permanently yet movably retained onto a bottle neck and the dispensing aperture is opened by a twisting or pulling motion. A problem common to many of the fluid dispensing closures appears to be a weakness in the sealing, especially during shipping when the containers are exposed to a significant change in air pressure or temperature.

Although my invention is necessarily somewhat similar to the past art bottle closures, I feel I have provided improvements in a uniquely structured closure for a bottle.

SUMMARY OF THE INVENTION

The invention is a twist open, twist close plastic dispensing cap for use with a cooperatively structured plastic bottle neck attached to a bottle. My bottle closure is primarily structured for, but not limited to dispensing fluids such as shampoos and lotions. My invention provides improved fluid sealing made possible by a dispensing aperture located on an outer annular beveled edge on the top outer corner of the cap. This placement of the dispensing aperture has been found by some to be much more convenient for dispensing, allowing the bottle to be held at an angle rather than straight up vertically. The angled placement of the bottle allows for better viewing of the amount of substance being dispensed.

The twist open/close feature of my closure does not involve raising or lowering the cap on angled threads, but instead works on direct clockwise or counter clockwise rotation of the cap to open and close a dispensing canal of the closure. The rotational motion allows tight fitting contact between most of the seals even during dispensing.

The improved sealing structure of my closure includes three concentric annular seal rings depending from the top interior ceiling of the cap. The three concentric seal rings are positioned to be received by corresponding grooves located on the upper or top edge of the bottle neck when the cap is fully installed. The central annular seal ring is significantly larger than the other two seal rings and extends downward forming a flange or tongue designed to be pressed into the larger central groove of the three grooves of the bottle neck. This connection forms a tight fluid seal while still allowing rotational movement of the cap on the bottle neck. A dispensing notch is provided in the central annular seal ring.

The dispensing canal of the closure which the fluid is dispensed through is formed of an aperture through an interior wall of the cap and a second aperture through the exterior wall of the cap. The top of the bottle neck has a dispensing notch positioned to allow the cap to be rotated to align the apertures of the cap with the notch of the bottle neck. This rotation also positions the dispensing notch of the central annular seal ring in alignment with the dispensing notch of the bottle neck and the dispensing apertures of the cap. The alignment of all dispensing apertures and notches forms an open dispensing canal for fluid to flow. The apertures of the cap and the notch of the central annular seal ring when misaligned with the notch of the bottle leave the dispensing canal closed.

A first stop block is located on the lower exterior of the bottle neck, and a second stop block is located on the lower interior cap rim to limit rotation of the cap to prevent inadvertent removal thereof. The stop blocks are also used to indicate when the dispensing apertures and notch of the cap are aligned with the notch of the bottle neck for dispensing.

To indicate the fully closed position of the dispensing canal, a small domed pin located on an interior wall of the cap is inserted into a dimple located on the exterior of the bottle neck when rotating the cap clockwise. This results in a definitive snap or click when the dispensing canal is closed.

Therefore, it is a primary object of my invention to provide a bottle closure with improved sealing and more convenient dispensing.

A further object of my invention is to provide a bottle closure which does not utilize a vertical rise to align the dispensing apertures, but merely uses rotation to allow for better sealing.

Another object of the invention is to provide a cap having structure which clearly indicates to the user both an open and a closed dispensing canal.

Other objects and advantages of my invention will become apparent with a reading of the remaining specification and a subsequent comparison with the accompanying drawings.

The cap has been rotated to misalign the dispensing apertures and notch of the cap with the dispensing notch of the bottle neck. The annular wall of the bottle neck is shown blocking the dispensing apertures of the cap, and the central annular seal ring of the cap now blocks the dispensing notch of the bottle neck.

Figure 5:
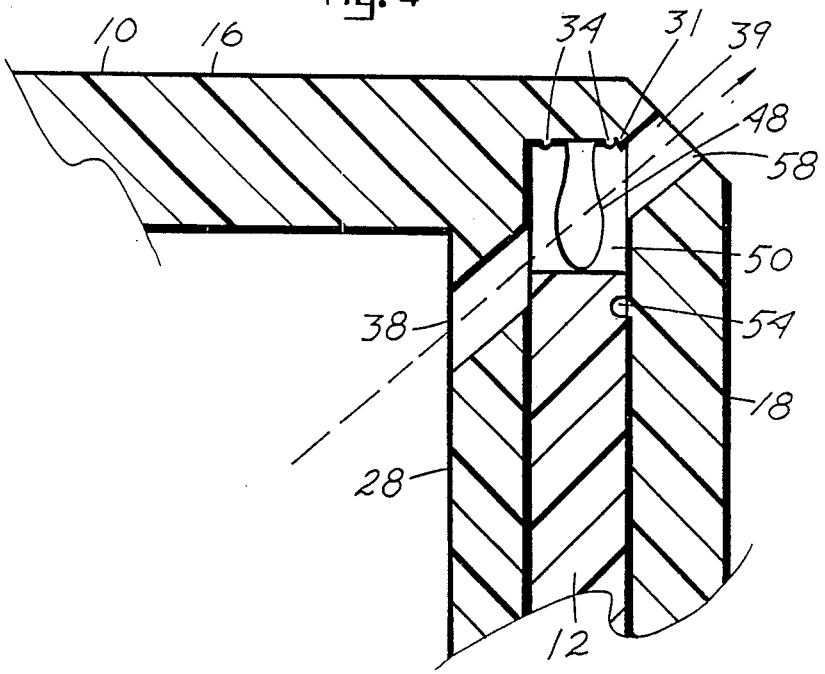

FIG. 5 is an enlarged cross sectional side view of an upper corner portion of the cap assembled onto the bottle neck showing the dispensing canal open.

Figure 3:
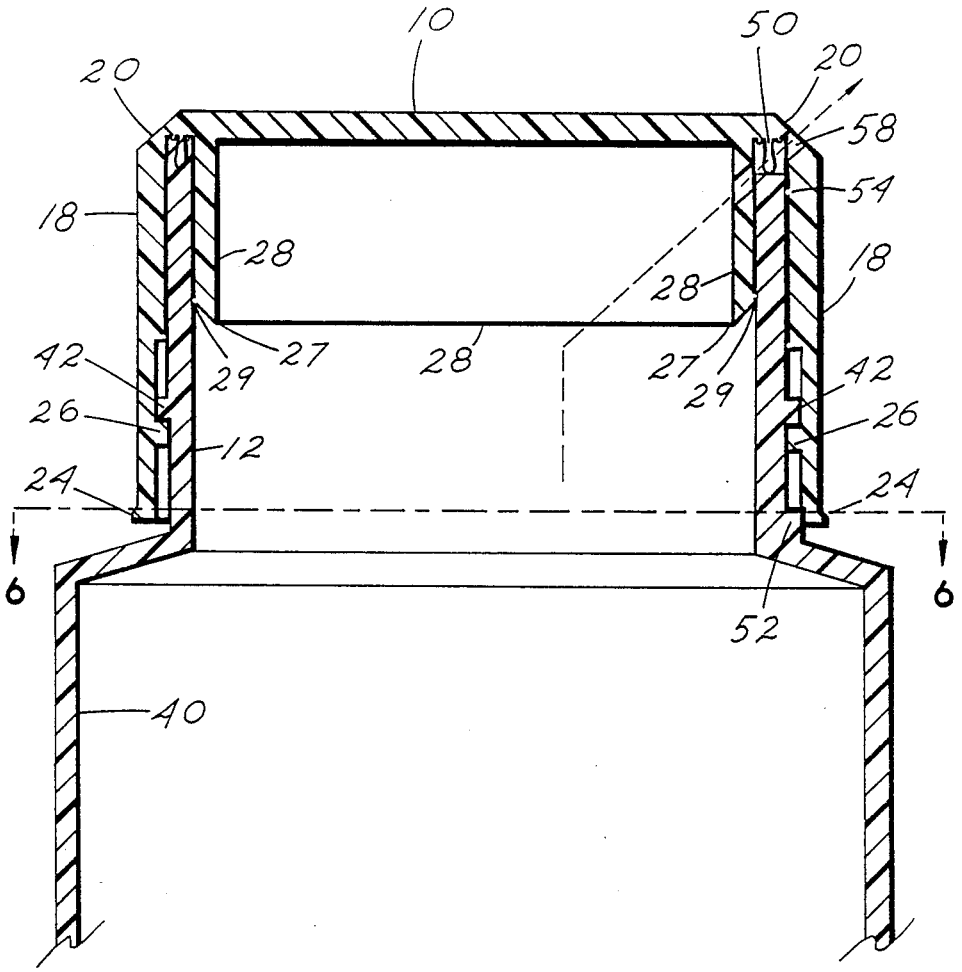
FIG. 3 is a cross sectional side view of the cap attached to the bottle neck with the dispensing canal in the open position. The dotted line represents the direction of the fluid flow through the open dispensing canal. The interior wall of the cap is shown fitting tightly against the interior surface of the bottle neck to form an additional fluid seal.
Figure 6:
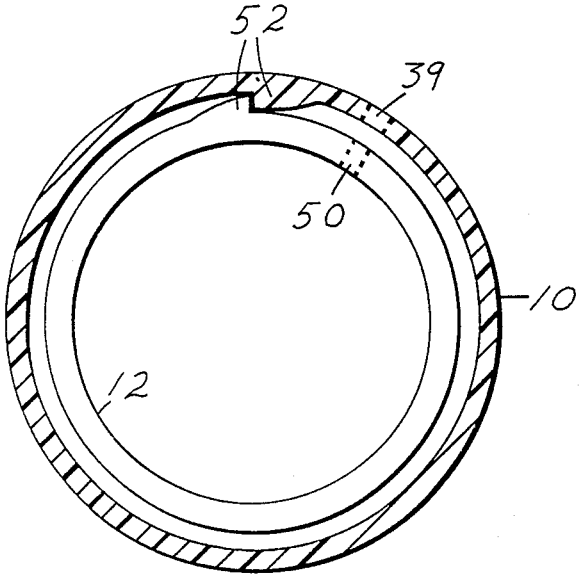

FIG. 6 is a cross sectional top view of the cap and bottle neck as shown at section line 6 of FIG. 3. The stop blocks are depicted abutting one another to both align and indicate an open dispensing canal. Dotted lines are used to illustrate the positioning of the open dispensing canal with the stop blocks abutted, although the canal would actually not be seen with section line 6 of FIG. 3.

Figure 7:
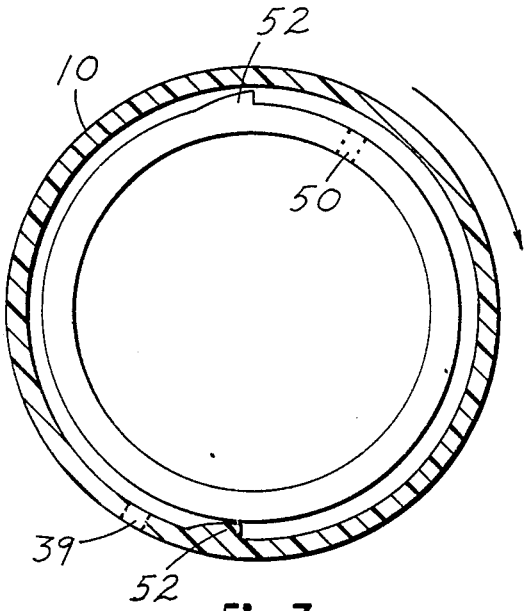

FIG. 7 is the same view as FIG. 6 but with the cap rotated clockwise to close the dispensing canal. The closed dispensing canal is also shown using dotted lines to indicate the misalignment of the dispensing notch of the bottle neck and the dispensing aperture of the cap when the stop blocks are not abutted.

Figure 8:
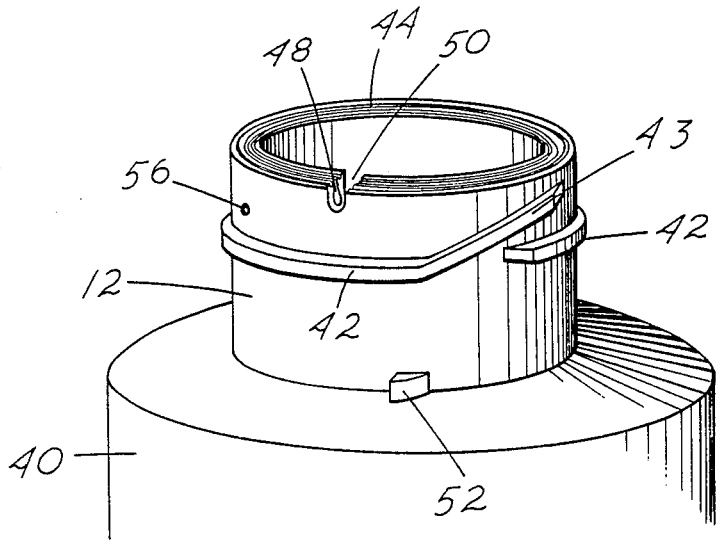

FIG. 8 is a perspective view of the upper section of a bottle with my modified bottle neck attached. Shown on the bottle neck are the dispensing notch, annular seal grooves, close indicating dimple, and the stop block. Also shown is a thread-like structure encircling the bottle neck. The thread-like structure has a single sloped starting ramp which levels out to continue the remainder of the way around the bottle neck in the same general plane.

Figure 9:
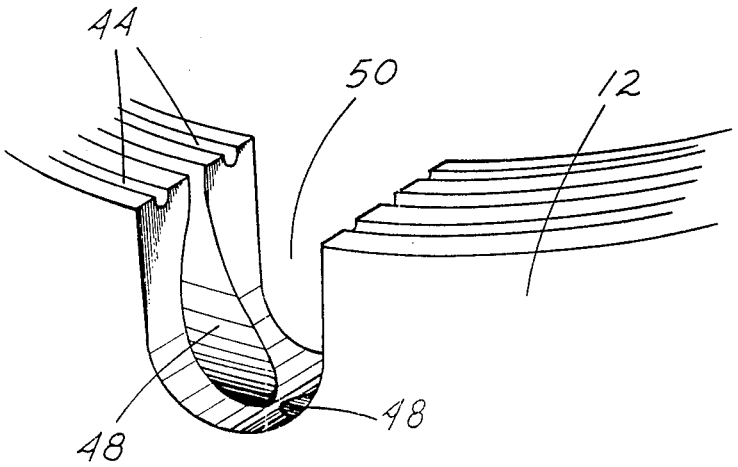

FIG. 9 is a perspective enlargement of the dispensing notch of the bottle neck with the central annular seal groove extending transversely through the center of the notch.

Figure 10:
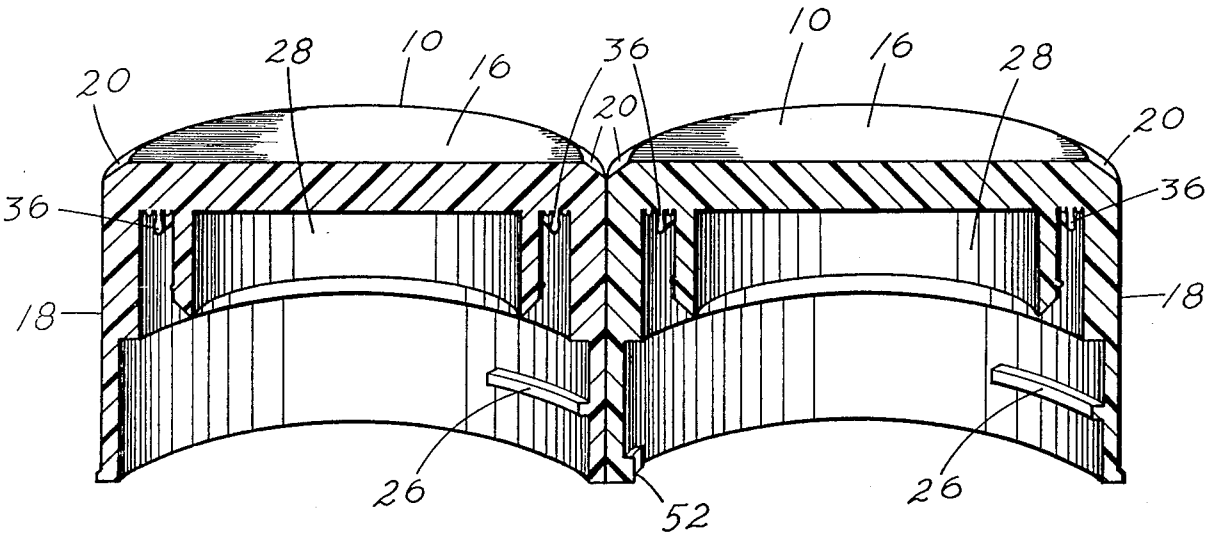

FIG. 10 is a cross sectional view of the cap with the cap vertically sectioned centrally and folded back. Shown are two short elongated cap locking bars adjacent the lower opened end of the cap. The cap locking bars are adapted to be positioned underneath the thread-like structure shown in FIG. 8 to retain the cap on the bottle neck. The sloped starting ramp of the thread-like structure is used to position the cap locking bars underneath the thread-like structure during initial assembly of the closure.

Figure 11:
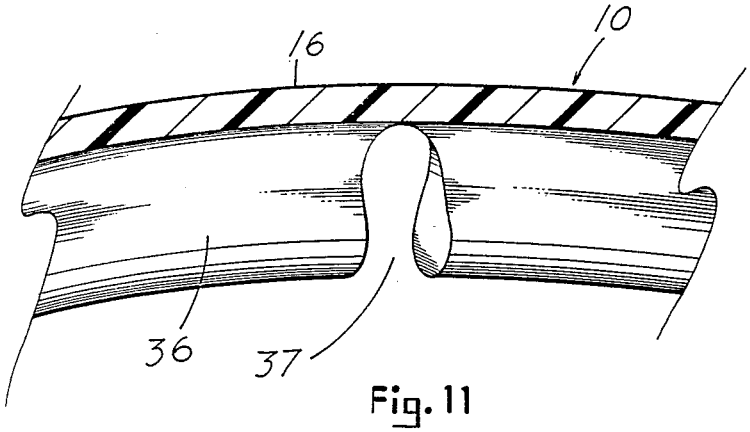

FIG. 11 is a short sectional view of the central annular seal ring of the cap showing the dispensing notch of the ring. The dispensing notch of the ring is adapted to rotate with the cap to come into alignment with the dispensing notch of the bottle neck to allow dispensing.

Figure 12:
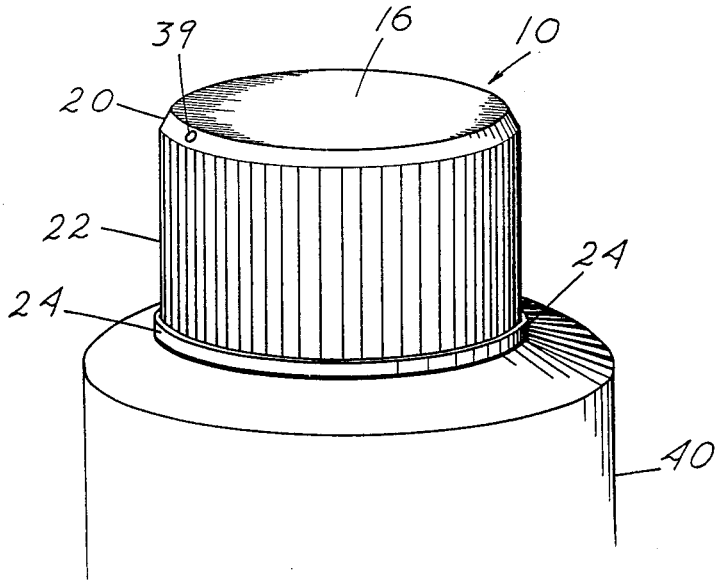

FIG. 12 is an assembled perspective view of the closure on a bottle.

DESCRIPTION OF THE PREFERRED EMBODIMENT

Referring now to the drawings where the immediate invention is illustrated in detail. The closure comprises both cap 10 and bottle neck 12 for a bottle 40. Cap 10 is ideally suited for injection molding using a thermoplastic material such as polyethylene or the like. The plastic should have a degree of flexibility to allow the initial installation of cap 10 onto bottle neck 12. Cap 10 is a cylindrical member having an open bottom end 14 and an oppositely disposed closed top end or surface 16. Cap 10 has an annular exterior wall 18 and a smaller diameter annular interior wall 28 placed concentric with wall 18. On the exterior surface of cap 10 at the juncture of top surface 16 and exterior wall 18 is beveled edge 20, best seen in FIG. 1 and 12. The exterior surface of cap 10 is textured with gnarled grip surface 22 except for a narrow band encircling the bottom which forms bottom rim 24, also best seen in FIG. 12.

Figure 1:
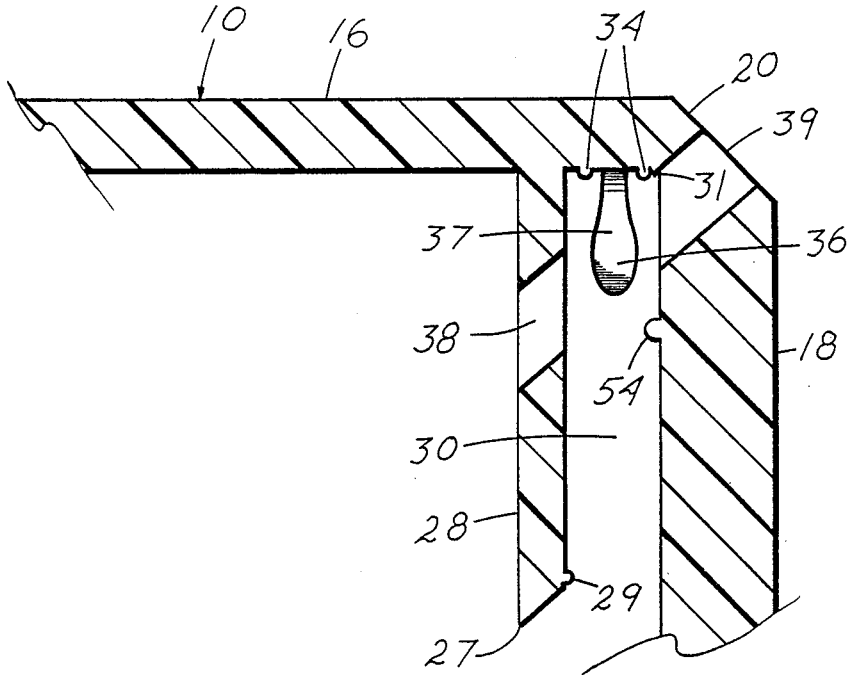
FIG. 1 is an enlarged cross sectional side view of an upper outer corner portion of the cap illustrating the first and second dispensing apertures extending through the exterior and interior walls of the cap. Also shown is the central annular seal ring centered between the interior and exterior walls of the cap. The three seal rings are shown depending from the underside of the cap top. Also shown is the small domed pin below the dispensing apertures used for a closed dispensing canal indicator.

Both walls 18 and 28 depend from the interior underside of top surface 16 of cap 10. Due to the differences in diameter between walls 18 and 28, a narrow space is maintained between the two walls. This narrow space is designated in the drawings as bottle neck housing 30, see FIG. 1. The interior underside of top surface 16 of bottle neck housing 30 is affixed with three concentric annular seal rings. The two small outer seal rings are designated seal rings 34. The central seal ring 36 is greatly enlarged in size compared to seal rings 34 and forms a downwardly depending flange or tongue as shown in FIG. 1. An additional seal is provided by housing seal 31 which is comprised of a small beveled corner positioned in the upper outer corner of the interior underside of top surface 16 of bottle neck housing 30. The upper outer edge of bottle neck 12 is forced against bottle neck housing seal 31 in use creating a fluid tight seal.

Figure 2:
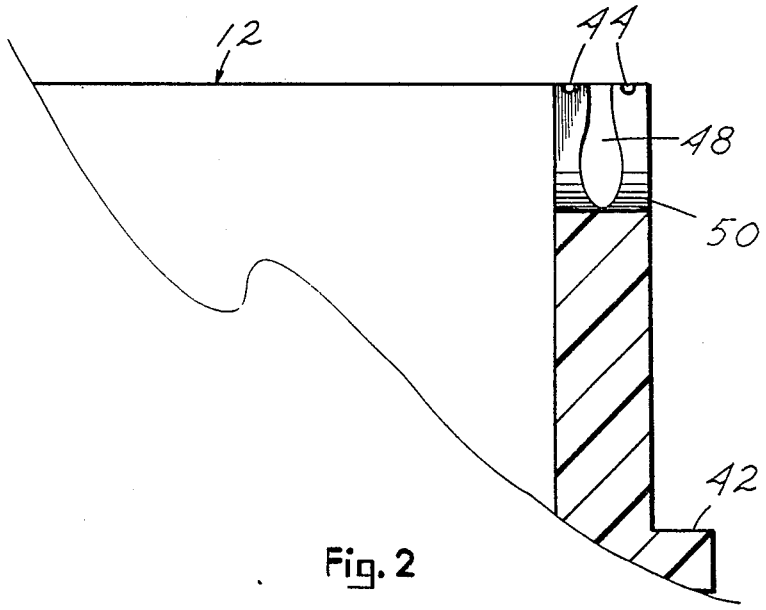
FIG. 2 is an enlarged cross sectional side view of an upper portion of the bottle neck illustrating the dispensing notch in the top rim. See FIG. 8 for an additional and more complete view of the dispensing notch of the top of the bottle neck. Also shown is the large central annular seal groove adapted to receive the central annular seal ring shown in FIG. 1. On each side of the central annular groove is a seal groove adapted to receive the two smaller annular seal rings.

As shown in FIG. 1, interior wall 28 has a dispensing aperture 38 aligned with a dispensing aperture 39 extending through exterior wall 18. Dispensing aperture 39 terminates at the exterior of cap 10 in beveled edge 20. Central seal ring 36 as shown in FIG. 1 extends downward from top surface 16 to terminate at a point equal to or slightly below the farther distant sides of dispensing aperture 38 and 39 toward open bottom end 14 of cap 10. This will be better understood by examining FIG. 2 and 9 where the central seal groove 48 which receives central seal ring 36 is shown extending directly through, and at the bottom of dispensing notch 50 of bottle neck 12.

Central seal ring 36 is solid or unbroken except in front of dispensing apertures 38 and 39 of cap 10. Drawing FIG. 11 illustrates a short section of central seal ring 36 with the dispensing notch 37 which is aligned with dispensing apertures 38 and 39.

Shown best in FIG. 1 is a small annular ridge designated sealing ring 29. Sealing ring 29 is positioned adjacent and parallel to the lower distal edge of interior wall 28 and helps to provide an additional seal between wall 28 and the interior surface of bottle neck 12 to prevent leakage of fluid between the two walls. Also, the distal edge of interior wall 28 is beveled inwardly to allow guided initial insertion into bottle neck 12 and is referred to as beveled rim 27.

The interior surface of exterior wall 18 is affixed with two cap locking bars 26 for connection onto bottle neck 12, see FIG. 3 and 10. Locking bars 26 are short sections of horizontal extensions which are cooperative with locking ridge 42 on bottle neck 12. The reduced wall thickness of exterior wall 18 shown in FIG. 3 and 10 toward the opened bottom end of the cap 10 is necessary to allow proper mating of the upper interior surface of wall 18 with the upper end of the bottle neck 12 while at that same time allowing cap locking bars 26 and locking ridge 42 to function properly.

Bottle neck 12, which may be positioned on the top surface of any size or shape of bottle, is a thin cylindrical wall sized for tight fitting insertion into bottle neck housing 30 of cap 10. It will be recognized by those skilled in the art that bottle neck 12 is well suited to be molded at the same time directly onto a plastic bottle during blow molding of the bottle 40. The outer surface of bottle neck 12 is affixed with an extending locking ridge 42 adapted to cooperatively function with the cap locking bars 26 of cap 10. Both locking bars 26 and locking ridge 42 function when assembled to allow rotation of cap 10 either clockwise or counterclockwise horizontally relative to bottle 40 and provides a connection that generally eliminates vertical play of cap 10 on bottle 40. The locking ridge 42 is a double ended structure. One end of the locking ridge 42 is angled upward to form a starting ramp 43 to cause the cap locking bars 26 to be pulled downward in a sliding motion underneath the locking ridge 42 during rotation of cap 10 in the initial installation. During this initial installation the first locking bar 26 abuts the underside edge of starting ramp 43. Rotation of cap 10 causes locking bar 26 to be driven downward along the underside slope of ramp 43. It is the flexibility in the plastic used to mold the cap 10 that allows this to occur since the second locking bar 26 on the cap will be laying in a different plane than the first at this time. With further rotation of the cap 10, the second locking bar 26 abuts the underside of the starting ramp 43 and is also forced downward along the ramp until both locking bars are below the level portion of the locking ridge 42. The placement of the locking bars 26 below the locking ridge 42 is adapted to maintain a constant pressure between the seal rings of the cap 10 and the seal grooves of the top edge of the bottle neck 12 by a continuous abutment of the same and of the top of the locking bars 26 with the bottom of the locking ridge 42.

During this initial installation, the stop block 52 on the cap 10 also uses starting ramp 43 to be positioned below locking ridge 42. During this initial installation, the stop block 52 on cap 10 and the stop block 52 on the bottle neck 12 are forced by each other. The stop blocks 52 being wedge shaped, abut with the sloped sides of the blocks 52 together with clockwise rotation of the cap. Further rotation of cap 10 causes the bottom rim 24 of cap 10 to flare outward slightly at the point of the two abutted stop blocks 52. The blocks 52 slide past each other and bottom rim 24 snap back into place. The straight sides of the stop blocks 52 are now facing each other. Rotation of the cap in the opposite direction from that used during installation will result in the two stop blocks 52 abutting straight sides together to stop or limit rotation in that direction of cap 10. This limiting is used to both prevent inadvertent removal of the cap 10 from bottle neck 12, and to indicate when the dispensing canal 58 is in the open position.

Figure 4:
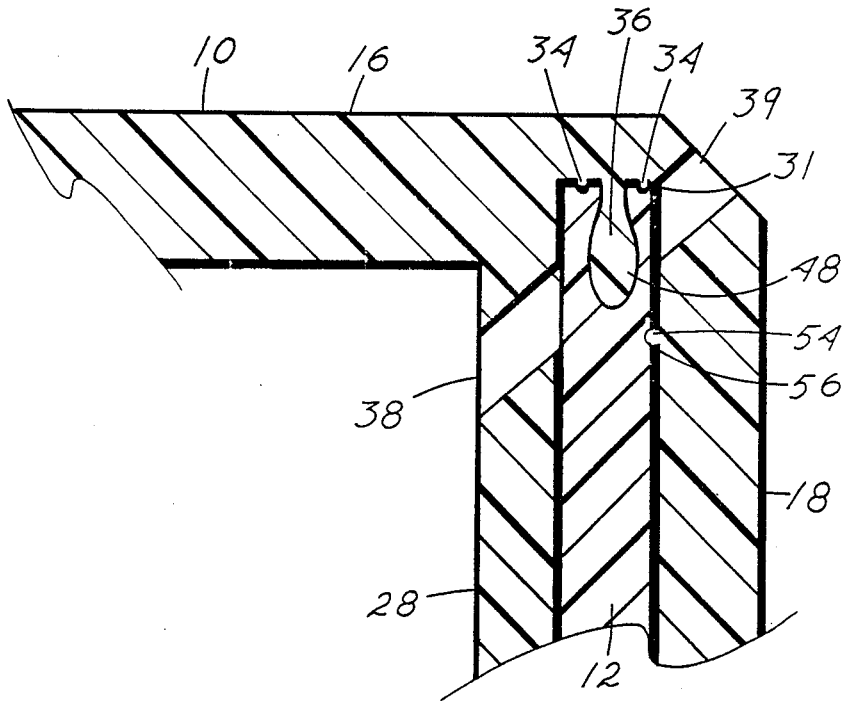
FIG. 4 is an enlarged cross sectional side view of an upper corner portion of the cap attached to the bottle neck with the dispensing canal in the closed position.

The top surface edge of bottle neck 12 is entrenched with three annular seal grooves which correspond and interlock with the annular seal rings of cap 10 when the cap is installed on bottle neck 12. The two outer seal grooves 44 are the smaller of the three grooves, and the central seal groove 48 is the larger of the three adapted to receive central seal ring 36 of cap 10. Also located on the top edge of bottle neck 12 is dispensing notch 50. Dispensing notch 50 is a semicircular notch cut through seal grooves 44 and 48 shown best in FIG. 9. Dispensing notch 50 is designed to be aligned with dispensing aperture 38 and 39 of cap 10, and dispensing notch 37 of central seal ring 36 of cap 10 by rotation of the cap to form an open dispensing canal 58 for the contents of the container as shown in FIG. 3 and 5. Rotation of cap 10 is also used to misalign the dispensing apertures and notch of the cap with the dispensing notch 50 of the bottle neck 12 to close the dispensing canal 58 as shown in FIG. 4.

To provide a more definitive position for the closed or sealed state, structure has been provided to indicate to the user that cap 10 has been rotated sufficiently clockwise to close dispensing canal 58. This is provided by the interaction of close indicating domed pin 54 and close indicating dimple 56. Domed pin 54 is a small domed shaped embossment on the interior surface of exterior wall 18 of cap 10 directly beneath dispensing aperture 39. Domed pin 54 when not positioned in dimple 56 slides against the outer surface of bottle neck 12. Because pin 54 is so small and exterior wall 18 is slightly flexible and resilient, wall 18 bows slightly outward when pin 54 is not in dimple 56. The resiliency of wall 18 causes pin 54 to snap into dimple 54 when aligned. Dimple 56 is a concave recess sized for housing domed pin 54, which is located to the left of dispensing notch 50 on bottle neck 12, as seen in FIG. 8. Domed pin 54 and dimple 56 are adapted to interlock when cap 10 has been rotated clockwise a specified distance. The interlocking of domed pin 54 within dimple 56 is releasable by merely firmly rotating cap 10, preferably counter clockwise.

Although I have described my invention in specific detail, I reserve the right to modify my invention insofar as such modifications remain within the scope of the appended claims.

What I claim as my invention:

1. A closure for a bottle, comprising in combination;

a cap member having an annular exterior wall and a smaller diameter annular interior wall concentric with said exterior wall, said walls depending from a closed top end of said cap extending toward an oppositely disposed opened bottom end of said cap, a first dispensing aperture through said interior wall aligned with a second dispensing aperture through said exterior wall, said second dispensing aperture terminating at a juncture between said closed top end and said exterior wall of said cap, a space between said exterior wall and said interior wall, at least one annular seal ring depending from said closed top end of said cap between said two walls extending from said closed top end to at least a farther distant side of said first and second dispensing apertures, said annular seal ring having a dispensing notch aligned with said first and second dispensing apertures of said walls;

a generally cylindrical bottle neck attached to a bottle, said bottle neck adapted to fit into said space between said interior and exterior walls of said cap, means adapted to retain said cap on said bottle neck, a top edge of said bottle neck having an annular groove therein with said annular groove adapted to receive said annular seal ring of said cap to form a generally fluid tight seal therebetween, a dispensing notch in said top edge of said bottle neck positioned to allow alignment with said dispensing apertures and said dispensing notch of said cap by rotation of said cap relative to said bottle neck to form an open dispensing canal, means adapted to indicate said open dispensing canal, means adapted to indicate a closed said dispensing canal.

2. The closure as described in claim 1 wherein said means adapted to indicate said open dispensing canal is a first stop block on said bottle neck and a second stop block on the interior surface of said exterior wall of said cap adapted to abut said first stop block upon opening of said dispensing canal with said rotation of said cap.

3. The closure as described in claim 1 wherein said means adapted to indicate a closed said dispensing canal is a domed pin on an interior surface of said exterior wall of said cap adapted to snap into a dimple on said bottle neck upon closing of said dispensing canal.

4. The closure as described in claim 1 wherein said means adapted to retain said cap on said bottle neck includes a two-ended thread-like structure extending in a generally horizontal plane around said bottle neck, one said end of said thread-like structure being curved toward said top edge of said bottle neck adapted to serve as a starting ramp for at least two cap locking bars attached to an interior surface of said exterior wall of said cap, said cap locking ramps adapted to slide under said starting ramp into position under said horizontal portion of said thread-like structure.

* * * * *